United States Patent [19]

Sue

[11] Patent Number: 4,703,683

[45] Date of Patent: Nov. 3, 1987

[54] FLUID ACTUATOR WITH INTERNAL LOCKING

[75] Inventor: Bing S. Sue, Hicksville, N.Y.

[73] Assignee: Grumman Aerospace Corporation, Bethpage, N.Y.

[21] Appl. No.: 880,631

[22] Filed: Jun. 27, 1986

Related U.S. Application Data

[63] Continuation of Ser. No. 697,942, Feb. 4, 1985, abandoned, which is a continuation of Ser. No. 319,107, Nov. 6, 1981, abandoned.

[51] Int. Cl.[4] ..... F15B 15/26

[52] U.S. Cl. ..... 92/24; 92/27; 188/67

[58] Field of Search ..... 92/14, 23, 24, 27, 28; 188/67

[56] References Cited

U.S. PATENT DOCUMENTS

| | | | |
|---|---|---|---|
| 1,063,598 | 6/1913 | Richards | 92/14 |
| 2,204,279 | 6/1940 | Meyer | 92/26 |
| 2,221,979 | 11/1940 | Levy | 92/26 |
| 2,360,535 | 10/1944 | Ashton . | |
| 2,713,328 | 7/1955 | Driskel . | |
| 2,866,315 | 12/1958 | Schakel | 92/14 |
| 2,876,746 | 3/1959 | Storrs . | |
| 2,887,991 | 5/1959 | Driskel . | |
| 2,949,889 | 8/1960 | Ivankovics . | |
| 2,971,497 | 2/1961 | De Vost | 92/14 |
| 3,010,752 | 11/1961 | Geffner | 92/14 |
| 3,107,582 | 10/1963 | Royster | 92/24 |
| 3,108,513 | 10/1963 | Koshobu | 92/24 |
| 3,217,609 | 11/1965 | Royster | 92/24 |
| 3,251,278 | 5/1966 | Royster . | |
| 3,429,233 | 2/1969 | Wright | 92/24 |
| 3,498,182 | 3/1970 | Sheffer | 92/24 |
| 3,584,544 | 6/1971 | Haberman | 92/24 |
| 3,941,141 | 3/1976 | Robert | 92/24 |
| 3,946,642 | 3/1976 | Bogenschutz | 92/24 |
| 4,024,800 | 5/1977 | Masclet | 92/26 |
| 4,240,332 | 12/1980 | Deutsch | 92/24 |

FOREIGN PATENT DOCUMENTS

| | | |
|---|---|---|
| 715739 | 1/1942 | Fed. Rep. of Germany . |
| 725770 | 9/1942 | Fed. Rep. of Germany . |

*Primary Examiner*—Abraham Hershkovitz

*Attorney, Agent, or Firm*—Richard G. Geib; Daniel Jay Tick; Bernard S. Hoffman

[57] ABSTRACT

A fluid actuator includes an internal lock assembly for locking an actuator piston to a cylinder of the actuator. A circumferential slot is located on the inner surface of the cylindrical wall for receiving locking latches which are radially extendable and retractable on the piston, and ball bearings are located between an inner aspect of each latch and a first abutment member on the piston. A second abutment member has a thickness less than about half the diameter of the ball bearings and is adapted to become wedged between the ball bearings and the first abutment means to force the latches radially outwardly into the slot for locking the piston relative to the cylinder and thereafter to abut only the latches to maintain locking.

19 Claims, 13 Drawing Figures

FLUID ACTUATOR WITH INTERNAL LOCKING

This is a continuation of co-pending application Ser. No. 697,942 filed on Feb. 4, 1985, now abandoned, which is a continuation of application Ser. No. 319,107, filed on Nov. 6, 1981 and now abandoned.

BACKGROUND OF THE INVENTION

This invention relates generally to fluid or hydraulically operated actuators wherein a piston translates within a cylinder and, more particularly, to a fluid actuator having internal locking means for locking the piston relative to the cylinder to provide an actuator of desired length, and to unlock the piston when desired.

Fluid actuators, operated by hydraulic or pneumatic pressure, are utilized in a large variety of applications, such as in extensible/retractable supports for aircraft landing gear, doors, etc. One of the most important features in such actuators is the incorporation of a locking mechanism which can rigidly maintain the actuator in a fully extended or fully retracted position after the hydraulic pressure, which causes the extension or retraction, has ceased.

Several designs are known for providing a locking capability in fluid actuator cylinders. One of the most common locking mechanisms involves a finger and ball arrangement such as shown in U.S. Pat. No. 3,429,233. Although these designs have proved adequate in certain applications, they suffer several drawbacks. For example, such devices are not capable of handling high loads with secure locking power and often require frequent replacement of parts, particularly ball bearings, when locking and unlocking are carried out under heavy loading conditions. The same disadvantages hold true for finger lock devices such as disclosed in U.S. Pat. No. 3,498,182.

A significant drawback to all known actuator locking mechanisms, particularly in aircraft and like applications, is that they are generally massive and large in size. The envelope required to house such locking mechanisms must necessarily be large and cannot be significantly reduced in size. This has presented a significant obstacle to the full utilization of the higher pressure, smaller size hydraulic system components which have recently been developed to allow substantial reductions in the weight of the overall hydraulic system.

Thus, while conventional hydraulic systems operate at about 3,000 p.s.i., recent efforts have resulted in increased operating pressures of up to 8,000 p.s.i., thereby permitting a reduction in the size of the system components in a ratio of about 8 to 3. However, because conventional locking mechanisms cannot be reduced in the same proportion, or even reduced at all, they represent a significant limitation on the ability to take full advantage of light weight, high pressure hydraulic components.

Ideally, the locking devices in such actuators should be formed in such manner that they do not overly increase the size of the actuators and that they can withstand repeated applications of relatively high loads, as compared with the forces exerted by the hydraulic pressure.

Accordingly, it is an object of the present invention to provide a new and improved fluid actuator, including locking means therefor. It is also an object of the invention to provide a new and improved actuator and locking means capable of functioning under high load conditions. Another object of the invention is to provide a new and improved actuator and locking means which enable secure locking of parts over relatively long term use under high load conditions, with relatively infrequent replacement of parts required.

It is still another object of the invention to provide a new and improved actuator and locking means which utilizes the convenience of ball bearings but does not subject the ball bearings to the locking forces. Further, it is an object of the invention to provide a new and improved actuator locking means which permits the size of the actuator envelope to be reduced in essentially the same proportion as the other components of the hydraulic system when higher pressure, lighter weight components are utilized.

It will be appreciated by those skilled in the art that although certain objects and advantages of the invention are set forth herein, other advantages will be appreciated herefrom or may be realized from practice with the invention which may be attained by means of the instrumentalities and combinations disclosed herein and defined in the appended claims. Accordingly, the invention resides in the novel parts, constructions, arrangements, instrumentalities and combinations herein shown and described.

SUMMARY OF THE INVENTION

Briefly described, the fluid actuator according to the present invention includes a locking mechanism which permits the actuator piston to be fixedly secured within the actuator cylinder in an extended or retracted position after the application of hydraulic pressure has terminated. In accordance with the invention, the actuator includes a set of radially extensible latches slidably mounted to the actuator piston and adapted to be extended for (and, when unlocked, retracted from) engagement with a circumferential slot formed along the interior surface of the cylinder at the location where locking is desired. There are at least two (and preferably three) latch members slidably mounted to the piston, with bearing means partially exposed at the radially inward portions of the latches. An annular member is spring-loaded in the actuator for urging, as the latches reach the slot, the bearing means radially outwardly and subsequently abutting a radially inward portion of each latch to prevent radially inward movement of the latches so that they remain seated in the slot.

In one embodiment, the annular member is slidable with respect to the piston shaft and adapted to lock the piston in a fully extended configuration. In another embodiment, the annular member is adapted to lock the piston in the fully retracted configuration.

It will be apparent from the foregoing that the objects and advantages of the invention specifically enumerated herein are achieved by the invention as herein disclosed. Thus, for example, it will be found that the fluid actuator according to the present invention permits the actuator piston to be locked at either extreme (fully extended or fully retracted) of piston travel. Moreover, such locking can be accomplished without requiring an increase in the size of the actuator.

It will also be found that the actuator and locking means according to the present invention are capable of operating for substantially long periods of time, with repeated applications at relatively high loading conditions. Furthermore, since the locking is carried out by the relative positioning of the annular member and interior edge portions of the latches, the danger of wearing out, or causing burnelling of, ball bearings or like bearing means is virtually eliminated since the bearings do not participate in the actual locking function. In addition, by using the latches insertable into a slot-like member according to the present invention, it will be found that the actuator is securely locked at the desired position but can easily slide within the actuator cylinder when unlocked. Furthermore, the locking mechanism in the actuator according to the invention is insensitive to (i.e., unaffected by) any rotation of the piston shaft.

It will be understood by those skilled in the art that the foregoing general description and the following detailed description are exemplary and explanatory of the invention, and are not intended to be restrictive thereof. Thus, the accompanying drawings illustrate preferred embodiments of the invention and, together with the following detailed description, serve to explain the principles of the invention.

BRIEF DESCRIPTION OF THE DRAWINGS

The foregoing features and other aspects of the invention are explained in the following description taken in connection with the accompanying drawings wherein.

Figure 1:
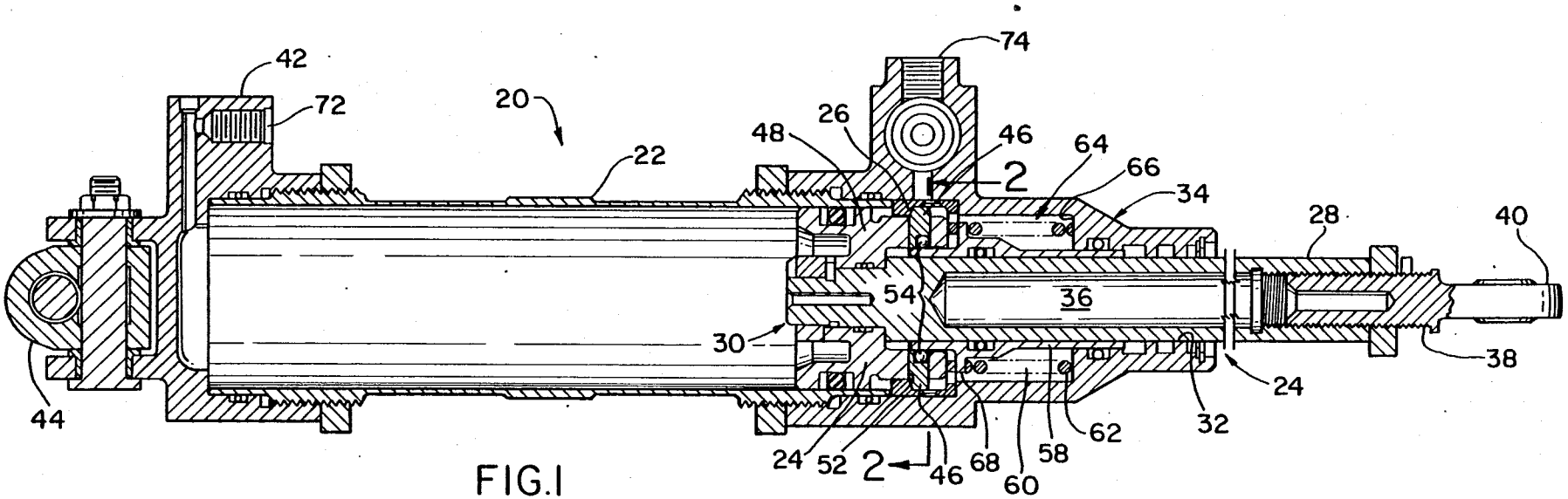
FIG. 1 shows a sectional view taken through a central axis of one embodiment (indicated by lines 1—1 of FIG. 2) of an actuator with locking means according to the present invention, showing the actuator in a locked, fully extended configuration.

FIGS. *4a–4e* are sectional views of the embodiment of FIG. 1, showing a sequence of extension and retraction of the actuator.

Figure 5:
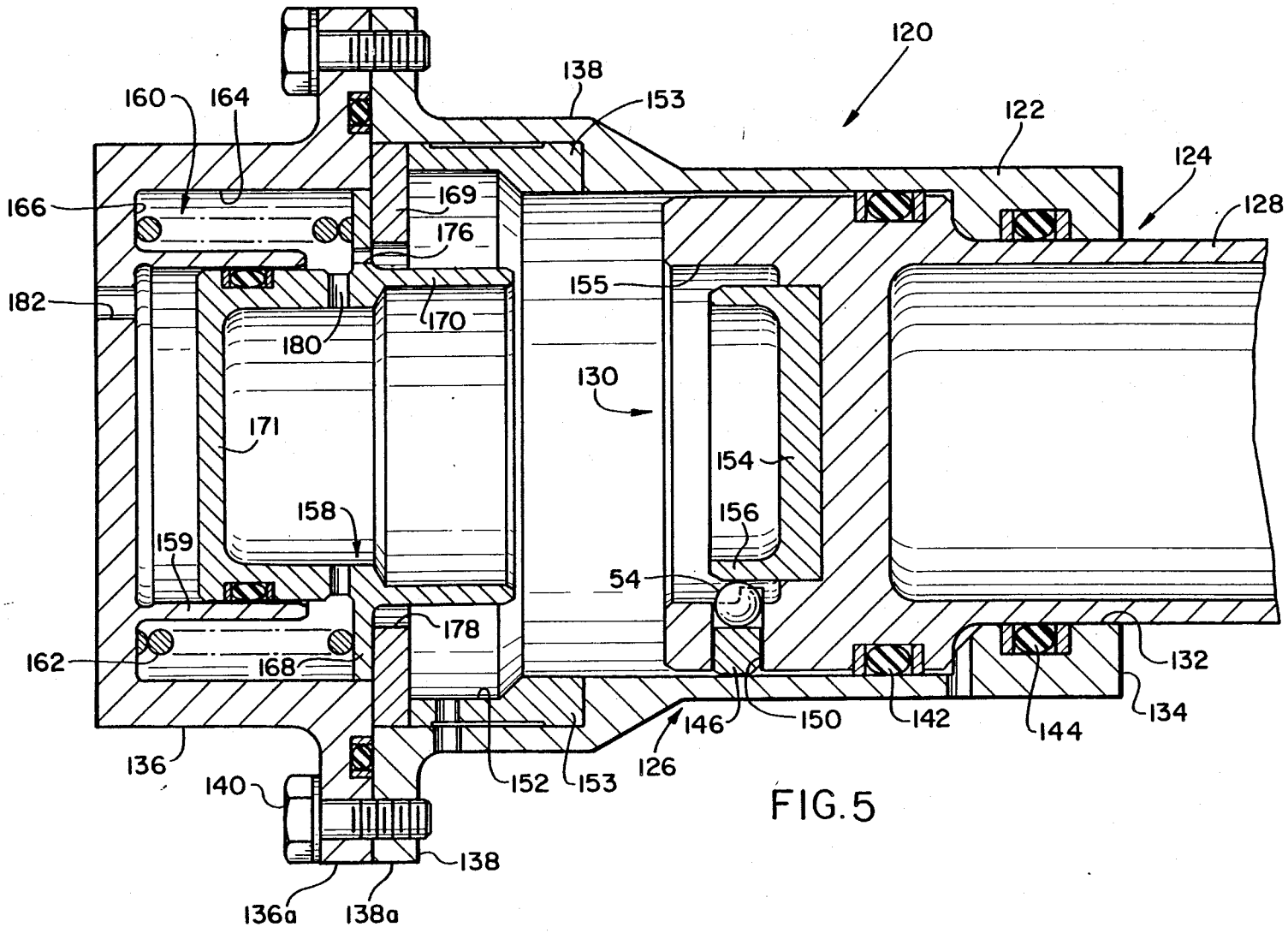

FIG. 5 is an enlarged sectional view of a portion of another embodiment of actuator with locking means according to the invention, showing the actuator in an unlocked, fully extended configuration.

FIGS. *6a–6d* are partial sectional views similar to that of FIG. 5, showing the sequence of movements during the actuator retraction and locking operation, and subsequent unlocking and extension.

DETAILED DESCRIPTION OF THE PREFERRED EMBODIMENT

Referring generally to the drawings wherein like reference numerals refer to like parts throughout the various views, there are shown two embodiments of a fluid actuator with locking means according to the present invention.

Figure 2:
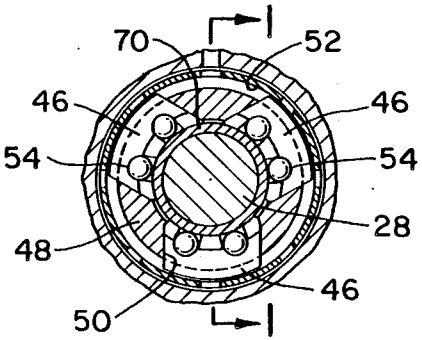
FIG. 2 is a sectional view of the embodiment of FIG. 1 taken along lines 2—2 in FIG. 1.

In FIGS. 1 and 2, there is shown one embodiment of a fluid actuator (indicated generally at 20) according to the present invention. Actuator 20 comprises an actuator cylinder, or envelope, 22 and a piston 24 adapted to slide in the cylinder under fluid or pneumatic pressure. A locking mechanism (indicated generally at 26) is adapted to lock piston 24 relative to cylinder 22 when the piston 24 is in the desired extreme position of travel (i.e., fully extended or fully retracted). As here embodied, actuator 20 is adapted to be locked in the fully extended position for use, e.g., in a landing gear assembly or the like. Locking mechanism 26 is generally circumferential in configuration and located just behind the head portion 30 of the piston 24. The shaft 28 of piston 24 slides within inner wall 32 of restricted portion 34 of the cylinder for guiding the shaft and piston during its sliding operation. An O-ring 48 or like sealing member is formed on the piston head for sealing engagement with the interior walls of the cylinder 22.

The shaft 28 of the cylinder has a central bore 36 and, as here embodied, is threaded at its outer end for mating with a union 38, or other like device, by which the piston is secured to some desired structure (indicated generally at 40) such as, e.g., the landing gear wheel assembly. Cylinder 22 is closed off at its other end by a suitable cap assembly 42 by which mechanical connection (indicated at 44) can be made between the cylinder 22 and an external mechanical member (not shown) such as an aircraft strut.

In accordance with the invention, lock assembly 26 comprises a set of latch members 46 (three are shown in FIG. 2) which are slidably received in the slot-like openings 50 formed in the piston head 30. Each opening, or slot, 50 extends all the way through the piston head which is coupled to shaft 28 so as to leave an annular space 53 between the interior surface of the piston head and the outer surface of the shaft 28. A circumferential slot 52 is formed in the wall of the cylinder 22, preferably by a separate race member 51, to lockably receive the latches 46, as will be described more fully below. A pair of ball bearings 54 (FIG. 2) are freely seated within a corresponding pair of notches 47 formed in each latch 46, which open towards space 53 and shaft 28.

Locking mechanism 26 further includes lock plunger 58 which is generally cylindrical and is mounted circumferentially about the shaft 28 for slidable movement relative to the shaft. A compression spring member 60 is mounted circumferentially about the plunger 58. Spring 60 may be retained on the plunger by friction fit between a portion of its coil and enlarged plunger neck portion 62, adjacent flange 68 of the plunger. Spring 60 is proportioned to be received within a cavity 64 formed in cylinder 22 adjacent restricted cylinder portion 34. The spring can thus be compressed between a backwall 66 of the cavity 64 and flange 68 of plunger 58 for resiliently biasing the plunger against the backwall 66, and the plunger is restrained against longitudinal movement by cylinder retaining flange 23 formed in cylinder 22.

The top end of the plunger 58 includes annular wall portion 70 having a thickness approximately equal to the corresponding dimension of annular space 53, so as to be receivable in space 53 for urging the ball bearings radially outwardly away from shaft 28 during the locking operation, as explained below. Since ball bearings 54 are freely seated in notches 47 and the latches 46 are freely slidable within openings 50 in the piston head, the radial forces exerted by the bearings 54 upon their respective latches 46 is almost negligible so as to permit the piston to slide freely within cylinder 22, without any interaction between latches 46 and the interior walls of cylinder 22. To this end, annular space 53 is proportioned so that the latch/ball bearing assembly 46/54 can be completely withdrawn within the confines of the external cylindrical surface of the piston.

In operation, when the piston 24 reaches its fully extended position (as shown in FIG. 1), spring 60 becomes compressed between wall 66 and flange 68, thereby forcing the annular wall member 70 of plunger 58 between the ball bearings 54 and the shaft 28—i.e., into annular space 53. During the initial contact, the ball bearings "roll" over the leading edge of annular wall 70 and are thereby urged in the radially outward direction.

The latches 46, in turn, are also forced in the radially outward direction so as to project beyond the outer surface of piston 24 and into annular slot 52 for locking the piston relative to cylinder 22. So long as annular wall 70 remains within annular space 53, latches 46 cannot move radially inwardly and remain, therefore, within the annular slot 52, preventing relative movement between the piston 24 and the cylinder 22.

Figure 3:
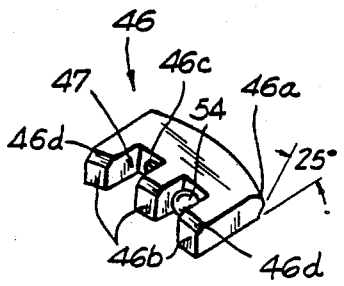
FIG. 3 is an enlarged perspective view of one latch-and-ball bearings assembly of the present invention.

Turning to FIG. 3, there is shown a preferred embodiment of a latch 46 (with one ball bearing 54 shown in place) for use in the present invention. The latch has the general form of a flat annular segment, with a curved outer edge 46*a* which conforms generally to the configuration of slot 52 (since it projects into the slot) and a curved interior surface 46*b* which conforms generally to the cylindrical shape of the outer surface of shaft 28. The two notches 47 are formed along the interior edge 46*b*, each proportioned to receive a ball bearing 54, and a small spherical bore 46*c* may be formed in the backwall of each notch to provide a seat for the ball situated therein.

The interior edge 46*b* is also beveled along one corner, as indicated at 46*d*, so as to permit a portion of the ball bearing 54 to project beyond the beveled surface 46*d* when the ball is fully seated in spherical bore 46*c*. In this way, the edge of annular wall member 70 first contacts the ball bearing (not the latches) during initial locking contact, thereby substantially reducing any wear of the latches and the plunger due to the locking operation. To this end, the leading edge of annular wall 70 should be rounded or otherwise made smooth to facilitate "rolling" past the ball bearing.

Each notch 47 preferably is slightly wider than the diameter of the ball bearings so that each ball is free to move within its corresponding notch. In addition, the depth of each notch 47 is greater than the diameter of the ball bearings so that, when the interior edges (46*b*) of the latches abut the plunger wall 70 in the locked configuration, the balls are still free to move within the notches when the actuator is locked. It will be understood that the ball bearings are restrained against movement in the axial direction of the cylinder by oppositely facing surfaces of opening 50 formed in the piston. It is preferred that the thickness of annular wall member 70 should be such that it will easily penetrate the space between the ball bearings and shaft 28 or otherwise contact the ball bearings at points radially inwardly of the middle of the ball bearing. A wall thickness of less than about ½ the ball bearing diameter, preferably about ⅓ to about 1/5 the ball bearing diameter, is believed to be satisfactory.

It will be understood that the only time the ball bearings are exposed to any force is during initial locking contact when the leading edge of annular wall 70 is being wedged between the ball bearings and shaft 28. However, such force is relatively small since it is only needed to urge the latches radially outwardly—i.e., in the direction perpendicular to the direction of movement of plunger 58. Once wall member 70 is fully positioned between interior latch surface 46*b* and shaft 28, no forces act on the ball bearings and they are free to move within the notches 47.

As shown in FIG. 2, in the locked configuration, annular member 70 abuts shaft 28 on one side and the interior edges of latches 46 on the other side to prevent retraction of the latches. Therefore, the only structures exposed to the locking forces are the latches 46, cylinder slot 52 and the piston 24.

Figure 4A:
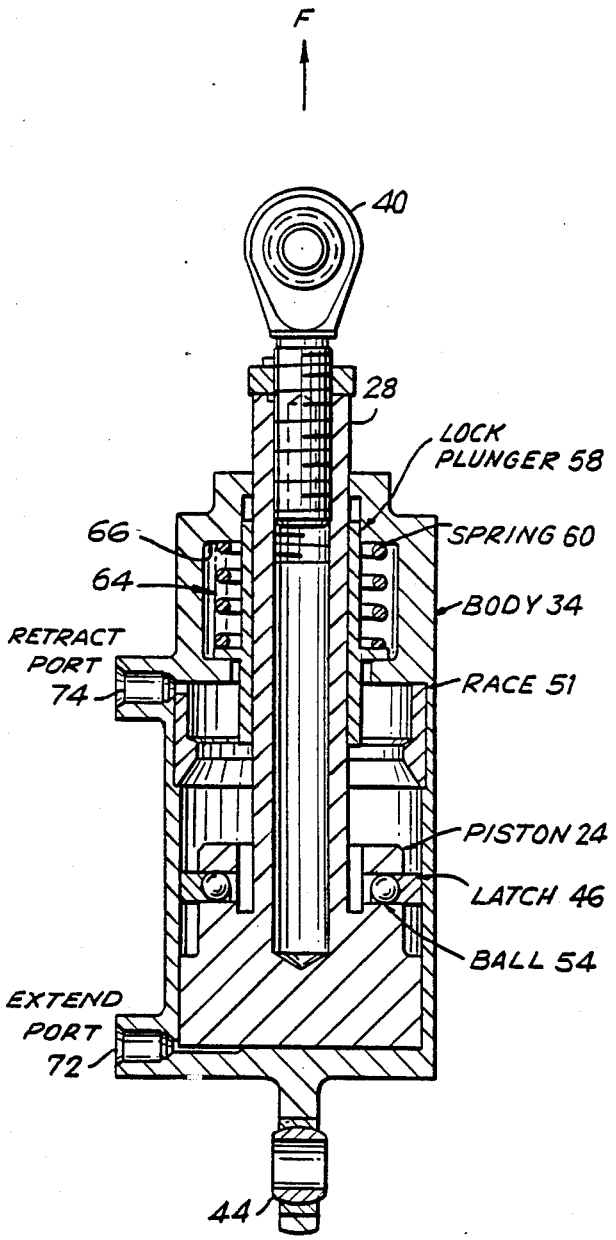

Full operation of the actuator according to the present invention is best appreciated from FIGS. 4*a*–4*e*. In FIG. 4*a*, the actuator is unlocked and in the fully retracted configuration. Although the latches 46 may touch the interior cylinder wall, there are no radially directed forces acting on them so they do not impede sliding movement of the piston.

Figure 4B:
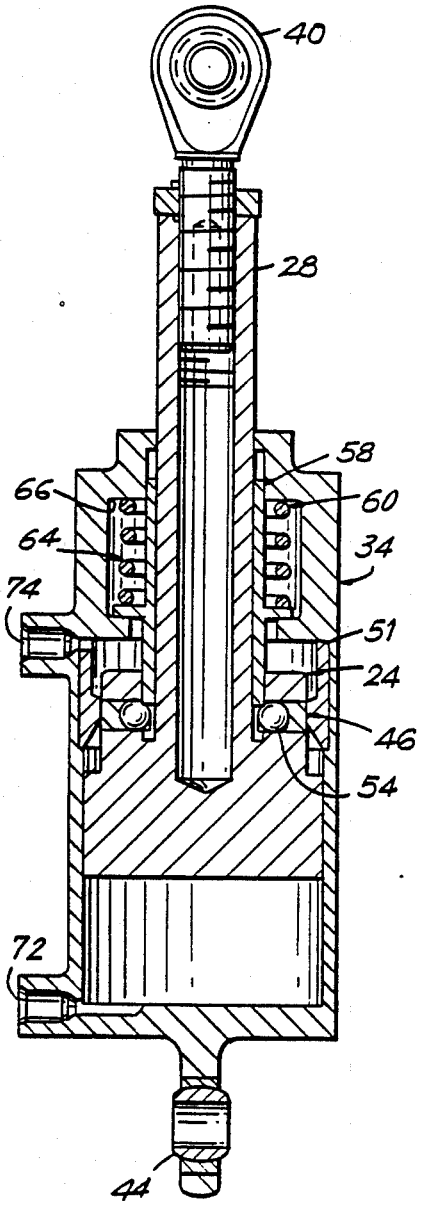

When the actuator is to be extended, fluid pressure is applied to the extend port (72 in FIG. 1), forcing the piston to slide away from the port. As the latches 26 reach the ramp-like portion of race 51, they move radially inwardly as shown in FIG. 4*b* due to the absence of any radially directed force. To facilitate such radially inward movement of the latches, the radially outward corners of each latch are preferably beveled (about 25°).

Figure 4C:
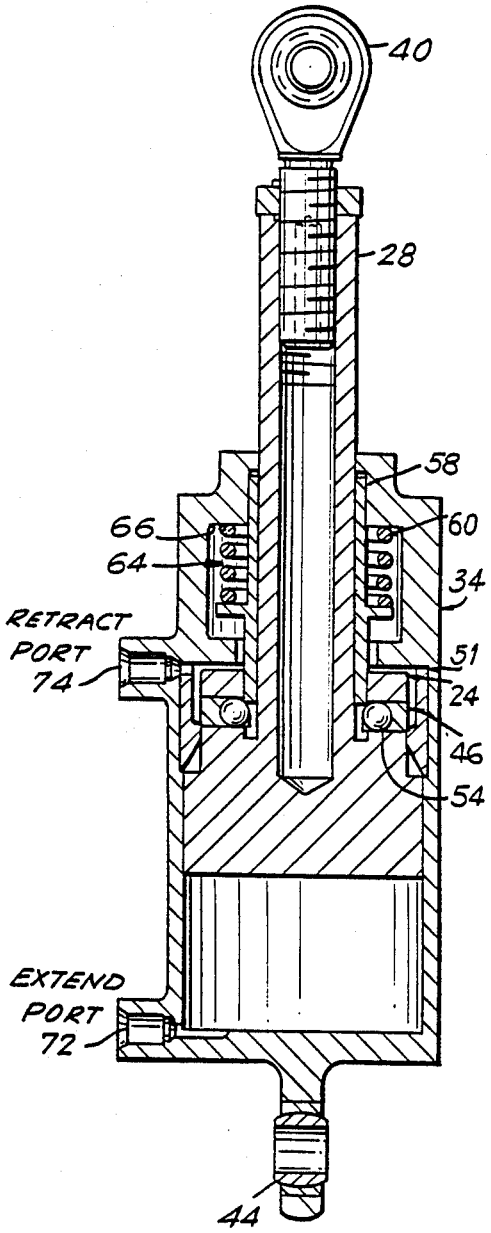

As further pressure is applied, the leading edge of annular wall member engages the ball bearings 54. This initial contact may result in a slight compression of spring 60, as shown in FIG. 4*c*, until the latches fully clear the ramp of race 51 to become seated in slot 52. With spring 60 biased between wall 66 and flange 68 on lock plunger 58, annular wall member 70 is constantly urged into the space between ball bearings 54 and piston shaft 28, thereby forcing the latches radially outwardly and into slot 52 once the latches clear the ramp of race 51.

Figure 4D:
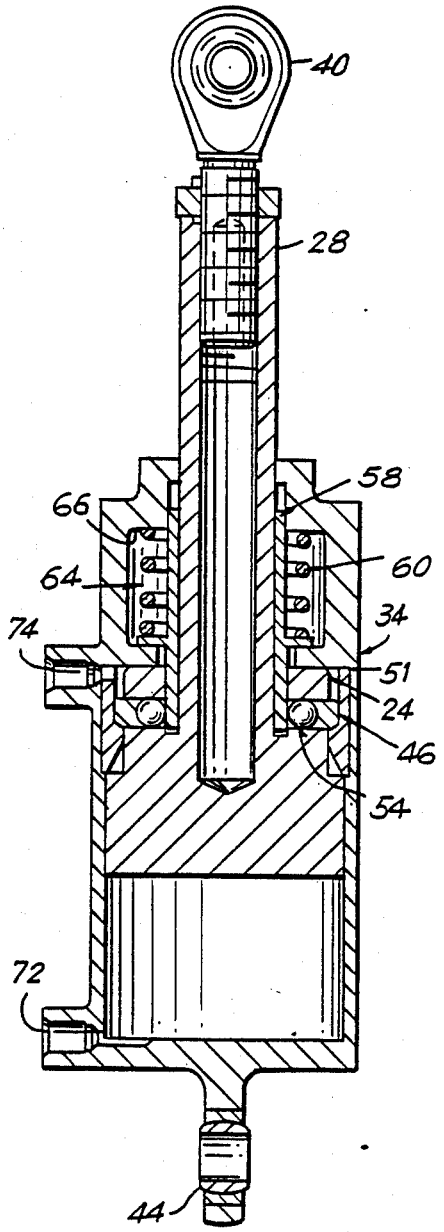

As the latches become seated in slot 52, the annular wall is received in annular space 53, as shown in FIG. 4*d*. The annular wall member abuts the radially inward surface of the latches to retain them in the locked configuration. It will be understood, then, that even after the application of fluid pressure ceases, the latches maintain a rigid interlocking of the cylinder and piston/shaft assembly.

Figure 4E:
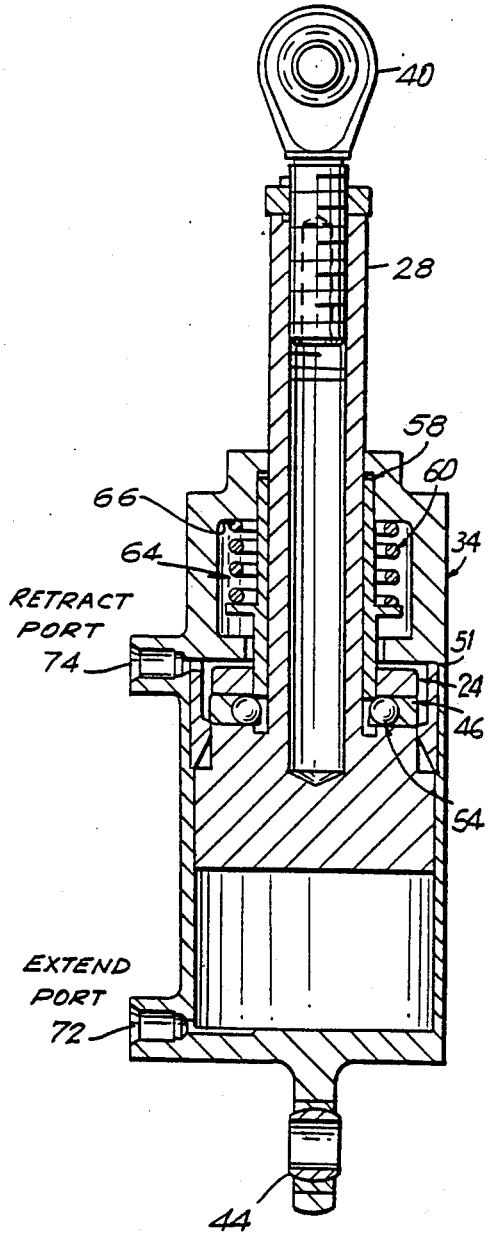

When the actuator is to be unlocked, fluid pressure is applied to the retract port (74 in FIG. 1), acting on the other side of piston 24. As pressure builds, it acts on flange 68, causing it to compress spring 60, as shown in FIG. 4*e*. The compression force results because the surface area of the flange on the side abutting the spring is smaller than that on the other side due to the enlarged portion 58*a* of plunger 58. After the leading edge of annular member 70 is withdrawn from annular opening 53, the latches are again free to slide radially in the piston openings 50. As a result, the latches can ride over the ramp-like portion of race 51 when the continuing application of pressure to retract port 74 forces the piston to retract. It will be understood that any otherwise conventional arrangement of fluid ports (including venting ports to vent the chamber appropriately while fluid pressure is being applied) may be utilized in the fluid actuator according to the invention.

Referring now to FIG. 5, there is shown a modified embodiment of the invention in which the locking mechanism is adapted to lock the actuator in the fully retracted configuration, such as when used for aircraft doors and the like. In both embodiments of the invention, a spring-loaded plunger has an annular wall member which moves behind sets of ball bearings to urge the latch members radially outwardly but comes to rest behind the latches to prevent unlocking. The actuator of the alternate embodiment (indicated generally by reference number 120) comprises a cylinder 122 with a slidable piston 124 which, as here embodied, is formed at the end of a hollow shaft 128 of enlarged diameter relative to the shaft of FIG. 1 and includes a locking mechanism associated with the piston for lockably securing the piston to the cylinder. The shaft 128 is adapted to slide along the inner wall 132 of a guide 134 formed integrally with the cylinder 122 at one end. A cap 136 closes off the other end of the cylinder 122 and is secured to a skirt 138 of the cylinder 122 by bolt 140 which passes through flanges 136*a* and 138*a* of the cap and skirt, respectively. A suitable sealing ring 142 encircles the piston head 130, and a second similar ring 144 encircles the inner surface of the wall 132 to prevent loss of hydraulic fluid.

The locking mechanism comprises a set of latches 146 (three sets are provided as in the embodiment of FIG. 1) which are slidably held within openings 150 formed in piston head 134 and ball bearings 154 which are essentially identical to latches 46 and bearings 54 described above. The latches can thus slide in the radial direction for engagement with a slot 152 located circumferentially around the inner surface of race 151 in the skirt 138. A cup-like member 154 sits within a cavity 155 in the front (or top) surface of piston head 130 to form annular opening 153. The openings 150 extend all the way into the cavity 155.

A plunger 158 is slidably secured within an annular member 159 upstanding from the interior wall 166 of the cap 136. A spring 160 is seated in the annular cavity 164 formed between annular member 159 and the annular wall portion of cap 136. The spring 160 biases the plunger in the direction away from cap 136 by acting between back wall portion 166 of cavity 164 and flange 168 of plunger 158. A flat ring member 169 is secured within the skirt 138, contiguous with the end of race 153 to limit translation of the flange 168 and thereby constrain movement of plunger 158 under the force of the spring 160. The forward end of plunger 158 terminates in an annular wall member 170 (similar to annular wall 70 described above) while the back end of the carriage 158 is closed by planar wall member 171.

It will be understood that piston 124 moves relative to the cylinder 122 as a result of hydraulic pressure from fluid applied to the extend port 172 and retract port 174. A passage 176 within the plunger flange 168 and an aperture 178 within the flat ring 169 permits the hydraulic fluid to flow into the cavity 164. Similarly, passages 180 in the side walls of the cup 171 permit the flow of hydraulic fluid within plunger 158 to flow into cavity 164. A vent port 182 vents the space between the plunger wall 171 and cap 136.

Referring to FIGS. 6*a*–6*d*, operation of the actuator embodiment illustrated in FIG. 5 will be readily apparent. With the actuator in the fully extended configuration (FIG. 5), fluid pressure is applied to retract port 174, causing the piston 130 to slide towards its retracted configuration. Again, since there is no radially directed force acting on the latches 146, the piston will slide freely and unimpeded by the presence of the latches.

Figure 6A:
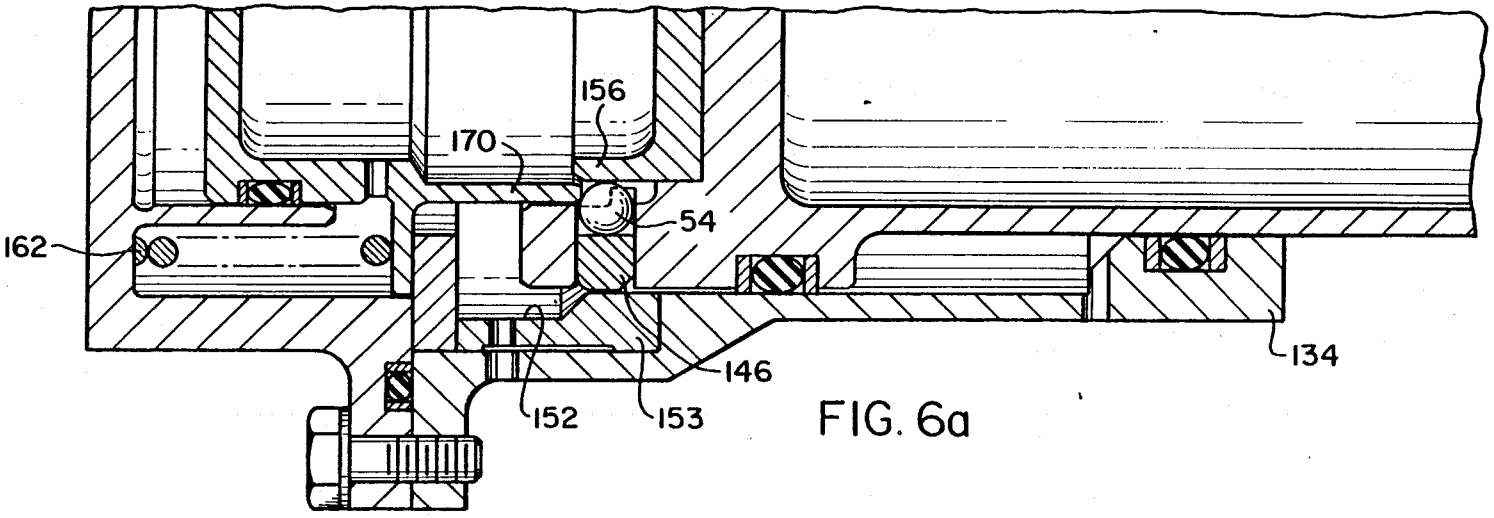
Figure 6B:
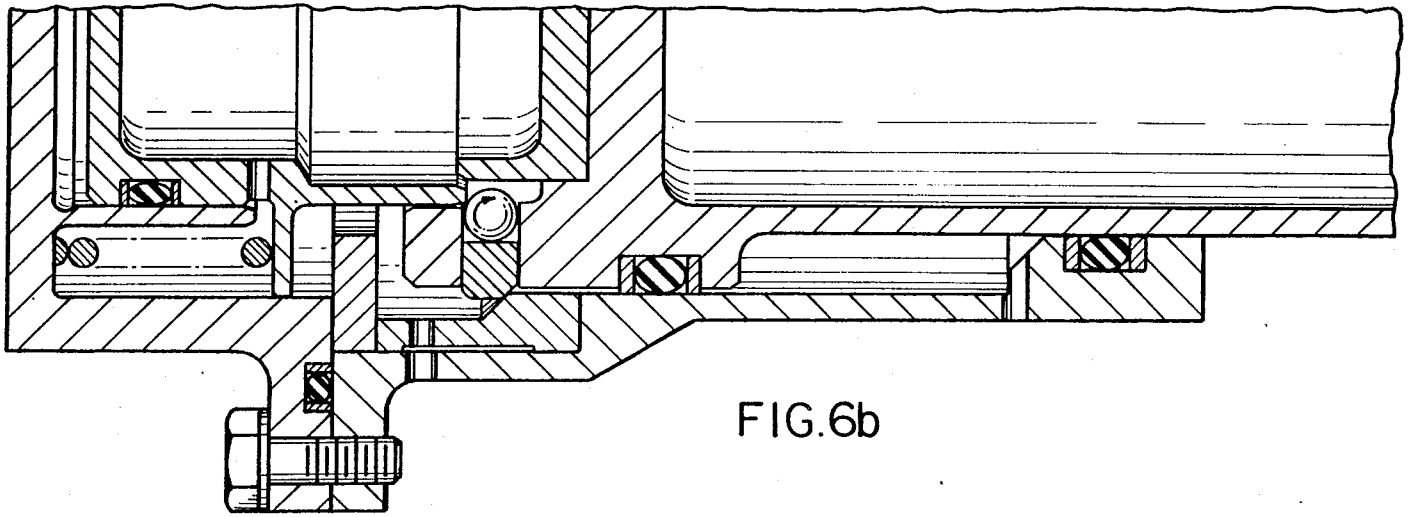

As the latches reach race 151, the leading edge of wall member 170 engages the ball bearings 154, as shown in FIG. 6*a*. Further retraction may result in some compression of spring 160 (since the latches are not in full registration with slot 152 of race 151) to urge the leading edge of wall 170 between ball bearings 154 and the annular wall of cup 156, as shown in FIG. 6*b*.

Figure 6C:
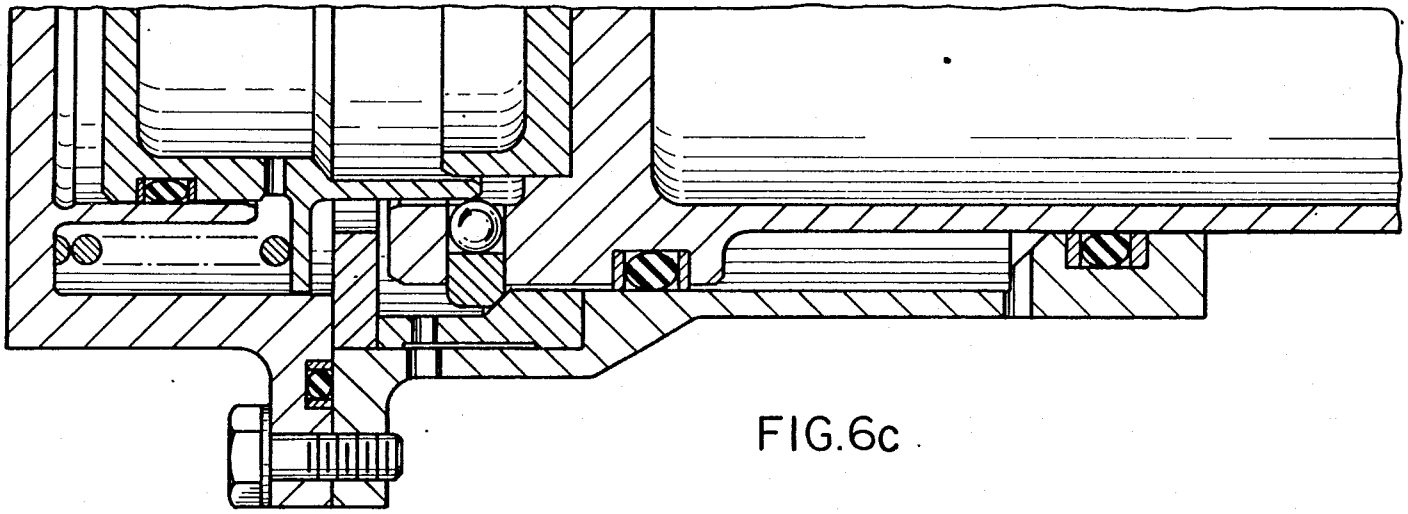

With continued application of the fluid pressure and complete registration of the latches 146 with slot 152, the annular wall 170 becomes fully seated in annular space 153 (i.e., between the interior side of the latches and the annular cup 156), as shown in FIG. 6*c*. The latches are thereby locked in place within slot 152, preventing any relative movement of piston 130 and cylinder 122.

Figure 6D:
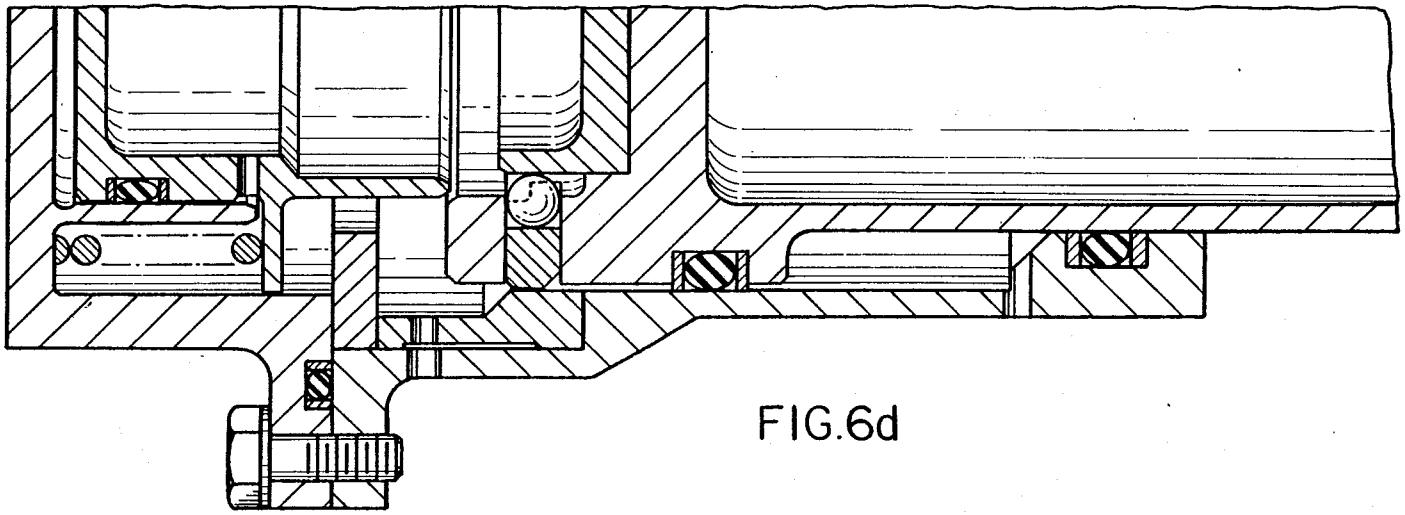

To unlock and extend the actuator, fluid pressure is applied to extend port 152. The fluid fills the chamber within plunger 158 and the pressure acts on its planar wall segment 171. The fluid pressure generates a compressive force on spring 160, causing the plunger to move toward planar wall 166. The annular wall 170 is thus withdrawn from annular opening 153, thereby freeing latches 146 to slide radially inwardly in their slots 150. As a result, the piston can slide freely towards its fully extended configuration, as shown in FIG. 6*d*.

The materials usable in the present invention are within the knowledge of those skilled in the art. Thus, for example, the piston shaft can be chrome-plated 15-5PH stainless steel, while the other structures such as the lock plunger, lock race, etc., can be 440-C stainless steel. The compression springs can be 17-7PH stainless steel and the cylinder retained flange can be 15-5PH stainless steel. The ball bearings can be 440-C or 15-5PH stainless steel. The remaining structures can be any conventional material, and the latches may be berrylium copper.

It will be appreciated that the use of separate race members 51 and 151 are advantageous in permitting the use of a higher strength material than for the cylinder. They also provide a small part at the place of greatest wear so that the part, not the entire actuator, can be replaced if the locking slot wears out. The races are held in place by force fit between, e.g., cylinder 122 and flange/cap 169/136.

It will be readily appreciated by those skilled in the art that the present invention is not limited to the specific embodiments herein shown and described. Rather, variations may be made, which are within the scope and spirit of the accompanying claims and still realize the principal advantages described herein.

What is claimed is:

1. In an actuator having a cylinder with an inner surface and a piston adapted to slide relative to the cylinder, locking means for locking the piston relative to the cylinder, said locking means comprising:

a race having a ramp like portion and disposed on the inner surface of the cylinder;

bearing means having a diameter and a projected portion and disposed on the piston;

first abutment means disposed on the piston;

second abutment means having an annular wall member with a leading edge and an interior surface and an exterior surface; and a plurality of latch members each having an interior edge with a corner and at least one notch having a width and a depth and a spherical bore and an exterior edge having an angled corner, said corner of said interior edge of each latch member of said plurality of latch members being beveled and permitting said projected portion of said bearing means to project beyond said beveled corner of said interior edge of said each latch member of said plurality of latch members when said bearing means is fully seated in said spherical bore so that said leading edge of said annular wall member of said second abutment means first contacts said bearing means not said plurality of latch members during initial locking contact so as to substantially reduce any wear on said plurality of latch members and said second abutment means due to the locking operation, said notches of said plurality of latch members having said width slightly wider than said diameter of said bearing means so that said bearing means are free to move within their corresponding notch in the locked position, said depth of said notch being greater than said diameter of said bearing means so that when said interior edge of each said latch member abuts said annular wall of said second abutment means said bearing means are free to move within said notches in the locked position, said thickness of said annular wall of said second abutment means being such so as to easily penetrate the space between said bearing means and said first abutment means, said bearing means being exposed to forces only during initial locking contact when said leading edge of said annular wall of said second abutment means is wedged between said bearing means and said first abutment means, said forces on said bearing means being relatively small since they are only needed to urge said plurality of latch members radially outwardly since once said annular wall member of said second abutment means is fully positioned between each said interior edge of said plurality of latch members and said first abutment means no forces act on said bearing means and they are free to move within said notches, in the locked position said interior surface of said annular wall member of said second abutment means abuts said first abutment means and said exterior surface of said annular wall member of said second abutment means abuts each said interior edge of said plurality of latch members to prevent retraction of said plurality of latch members so that the only structure exposed to the locking forces are said plurality of latch members and said ramp like portion of said race and said piston, during unlocking said plurality of latch members move radially inwardly from said ramp like portion of said race due to the absence of any radially directed forces, unlocking being facilitated by said each angled corner of said each exterior edge of said plurality of latch members.

2. A lock as defined in claim 1, wherein said second abutment means is movable on said first abutment means.

3. A lock as defined in claim 1, wherein said second abutment means is disposed in the cylinder.

4. A lock as defined in claim 2, wherein said first abutment means include a shaft.

5. A lock as defined in claim 3, wherein said first abutment means include a cup like member disposed in the piston.

6. A lock as defined in claim 2, wherein said plurality of latch members is three.

7. A lock as defined in claim 3, wherein said plurality of latch members is three.

8. A lock as defined in claim 2, wherein said bearing means include ball bearings.

9. A lock as defined in claim 3, wherein said bearing means include ball bearings.

10. A lock as defined in claim 2, wherein said second abutment means include a plunger.

11. A lock as defined in claim 3, wherein said second abutment means include a plunger.

12. A lock as defined in claim 2, wherein said plunger has an annular wall member.

13. A lock as defined in claim 3, wherein said plunger has an annular wall member.

14. A lock as defined in claim 2, wherein said plunger has an annular wall member with a thickness in the range of about one third to one fifth said diameter of said bearing means.

15. A lock as defined in claim 3, wherein said plunger has an annular wall member with a thickness in the range of about one third to one fifth said diameter of said bearing means.

16. A lock as defined in claim 2; further comprising biasing means for said second abutment means.

17. A lock as defined in claim 3; further comprising biasing means for said second abutment means.

18. A lock as defined in claim 2; further comprising biasing means for said second abutment means which include a spring.

19. A lock as defined in claim 3; further comprising biasing means for said second abutment means which include a spring.

* * * * *